US011326461B2

(12) United States Patent
Amadon et al.

(10) Patent No.: US 11,326,461 B2
(45) Date of Patent: May 10, 2022

(54) HYBRID RUBBER GROMMET FOR POTTED STATOR

(71) Applicant: United Technologies Corporation, Farmington, CT (US)

(72) Inventors: Colin G. Amadon, Kennebunk, ME (US); Thomas Freeman, Kennebunk, ME (US)

(73) Assignee: Raytheon Technologies Corporation, Farmington, CT (US)

( * ) Notice: Subject to any disclaimer, the term of this patent is extended or adjusted under 35 U.S.C. 154(b) by 220 days.

(21) Appl. No.: 16/571,435

(22) Filed: Sep. 16, 2019

(65) Prior Publication Data

US 2021/0079800 A1 Mar. 18, 2021

(51) Int. Cl.
*F01D 11/00* (2006.01)

(52) U.S. Cl.
CPC ..... *F01D 11/001* (2013.01); *F05D 2220/32* (2013.01)

(58) Field of Classification Search
CPC ..... F01D 11/00; F01D 11/001; F01D 9/00; F01D 9/023; F05D 2220/00; F05D 2220/31; F05D 2220/32; F05D 2220/321; F05D 2220/3212; F05D 2220/3213; F05D 2220/3215; F05D 2220/3216; F05D 2220/3217; F05D 2220/3218; F05D 2220/3219
USPC ..... 277/345
See application file for complete search history.

(56) References Cited

U.S. PATENT DOCUMENTS

| | | | | |
|---|---|---|---|---|
| 7,553,130 | B1 | 6/2009 | Mons et al. | |
| 7,637,718 | B2 | 12/2009 | Barnett et al. | |
| 9,840,929 | B2 * | 12/2017 | Barnett | F01D 9/042 |
| 10,233,764 | B2 * | 3/2019 | Thomas | F01D 9/042 |
| 2006/0067817 | A1 * | 3/2006 | Motherwell | F01D 9/042 415/191 |
| 2016/0024971 | A1 * | 1/2016 | Pearce | F01D 9/041 415/208.1 |
| 2016/0047257 | A1 | 2/2016 | Radomski et al. | |

* cited by examiner

*Primary Examiner* — Nathan Cumar
(74) *Attorney, Agent, or Firm* — Bachman & LaPointe, P.C.

(57) ABSTRACT

A hybrid grommet assembly for a vane comprising a body portion comprising a first lip opposite a second lip forming a slot receiver, said slot receiver configured to receive a shroud slot of a shroud; said body portion comprising a vane receiver extending from said body portion and configured to receive a vane; a fiber integral within said body portion; and a potting coupled to said grommet proximate said vane receiver, wherein said potting fills a gap between the grommet and the vane.

19 Claims, 4 Drawing Sheets

HYBRID RUBBER GROMMET FOR POTTED STATOR

BACKGROUND

The present disclosure is directed to gas turbine engines, and particularly to an improved grommet for guide vanes.

Gas turbine engine vane assemblies are usually provided downstream of the engine fan and/or of a low pressure compressor to reduce the swirl in the air flow entering the high speed compressor. Such guide vane assemblies must be resistant to foreign object damage while having a minimal weight.

An outer shroud contained in the engine casing includes slots that receive the vane root to retain the vanes in place. In such a configuration, an adhesive such as a potting compound or a rubber grommet can be used to improve the fit and seal leakage paths. It has been found that current potting material can form cracks due to wear and environmental exposure. The rubber potting can be prone to degradation through cracking and tearing through the thickness of the rubber. The cracks and tears can compromise the rubber's damping effect and provide unintended leakage paths. Using a grommet alone makes the positional accuracy of location the vanes in the assembly only as accurate as the tolerances in the vane, shroud slot, and grommet. Just using the rubber potting allows the tolerances of the parts to be taken up by the gap between the vane and slot.

SUMMARY

In accordance with the present disclosure, there is provided a hybrid grommet assembly for a vane comprising a body portion comprising a first lip opposite a second lip forming a slot receiver, the slot receiver configured to receive a shroud slot of a shroud; the body portion comprising a vane receiver extending from the body portion and configured to receive a vane; a fiber integral within the body portion; and a potting coupled to the grommet proximate the vane receiver, wherein the potting fills a gap between the grommet and the vane.

In another embodiment, the fiber extends into each of the first lip, the second lip, the body proximate the slot receiver and the vane receiver of the grommet.

In another embodiment, the potting is located between the grommet body portion at least one of above and below the vane receiver and coupled to the vane above the shroud.

In another embodiment, the potting is located proximate the vane receiver below the shroud.

In another embodiment, the slot receiver is configured to couple the grommet to the shroud.

In another embodiment, the fiber comprises strands of fabric.

In another embodiment, the body portion between the vane and the slot of the shroud has a thickness of about 0.03 inches and the potting has a thickness of about 0.07 inches.

In accordance with the present disclosure, there is provided a vane and shroud assembly with a hybrid grommet assembly comprising an inner shroud concentric with an outer shroud defining an annular gas flow path therebetween; a plurality of vanes extending radially between the outer shroud and the inner shroud; a grommet assembly coupled to the vane proximate the outer shroud and the inner shroud, each of the outer shroud and the inner shroud having a slot, the grommet assembly comprising: a grommet having a body portion comprising a first lip opposite a second lip forming a slot receiver, the slot receiver configured to receive the slot; the body portion comprising a vane receiver extending from the body portion and configured to receive the vane; a fiber integral within the body portion; and potting coupled to the grommet proximate the vane receiver, wherein the potting fills a gap between the grommet and the vane.

In another embodiment, the fiber extends into each of the first lip, the second lip, the body proximate the slot receiver and the vane receiver of the grommet.

In another embodiment, the potting is located between the grommet body portion above and below the vane receiver and coupled to the vane above the outer shroud and below the inner shroud away from the annular gas flow path.

In another embodiment, the potting is located proximate the vane receiver and proximate the annular gas flow path.

In another embodiment, the fiber comprises strands of fabric.

In another embodiment, the slot receiver is configured to couple the grommet to the slot.

In accordance with the present disclosure, there is provided a process for attaching a vane to a shroud slot comprising providing a shroud having an upper surface and a lower surface, the shroud having a slot; attaching a grommet to the shroud, wherein the grommet comprises a body portion comprising a first lip opposite a second lip forming a slot receiver, the slot receiver configured to receive the slot; the body portion comprising a vane receiver extending from the body portion and configured to receive a vane; a fiber integral within the body portion, wherein the fiber extends into each of the first lip, the second lip, the body proximate the slot receiver and the vane receiver of the grommet; inserting the vane into the vane receiver; and coupling potting to the grommet proximate the vane receiver, wherein the potting fills a gap between the grommet and the vane.

In another embodiment, the potting is located between the grommet body portion above and below the vane receiver and coupled to the vane above the shroud.

In another embodiment, the fiber comprises strands of fabric.

In another embodiment, the potting is located proximate the vane receiver opposite the shroud.

In another embodiment, the process further comprises varying a thickness of the potting to fit the grommet in the slot.

In another embodiment, the body portion between the vane and the slot of the shroud has a thickness of about 0.03 inches and the potting has a thickness of about 0.07 inches.

Other details of the hybrid grommet are set forth in the following detailed description and the accompanying drawings wherein like reference numerals depict like elements.

DETAILED DESCRIPTION

Figure 1:
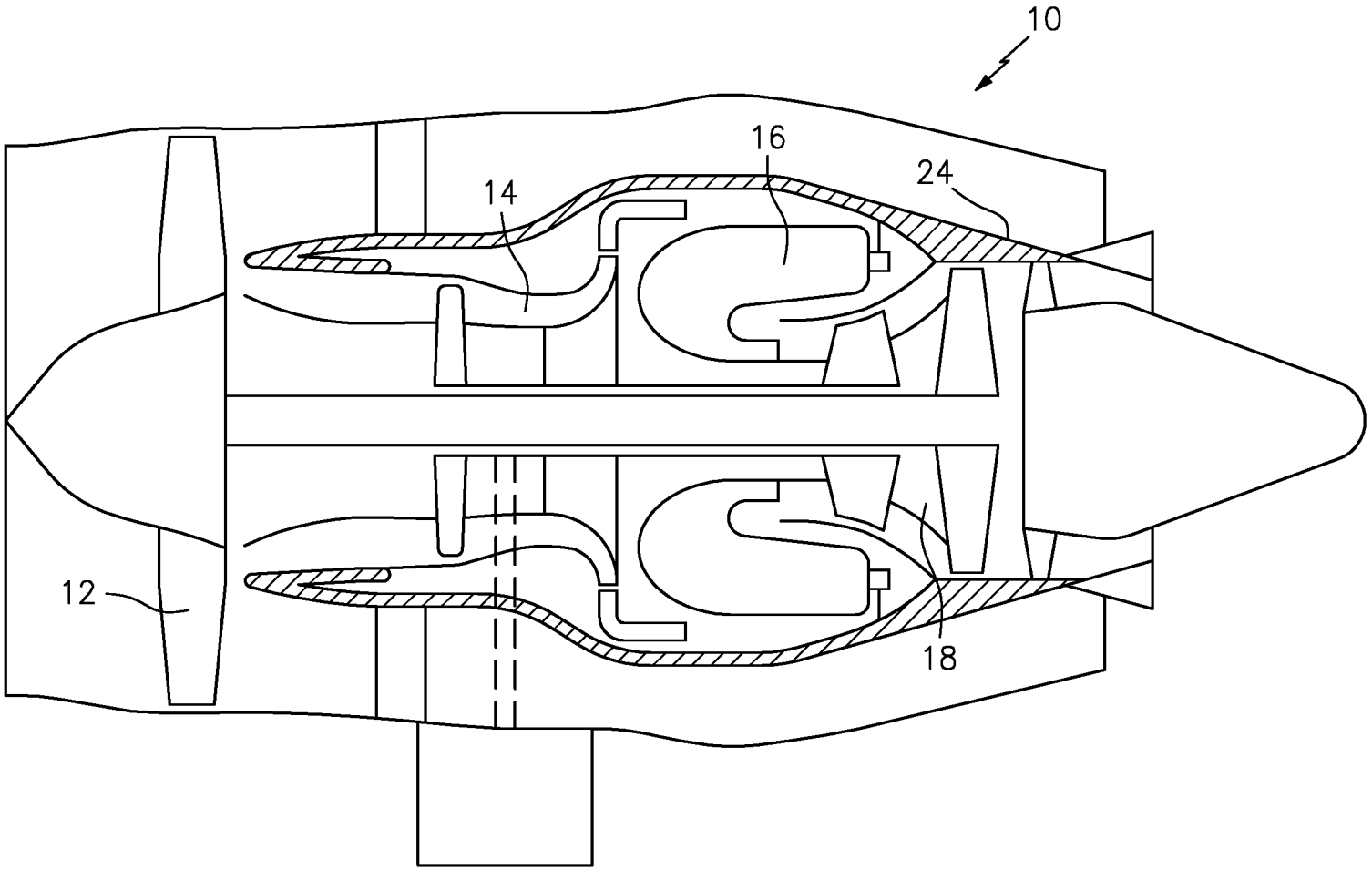
FIG. 1 is a side view of a gas turbine engine, in partial cross-section.

FIG. 1 illustrates a gas turbine engine 10 generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

Figure 2:
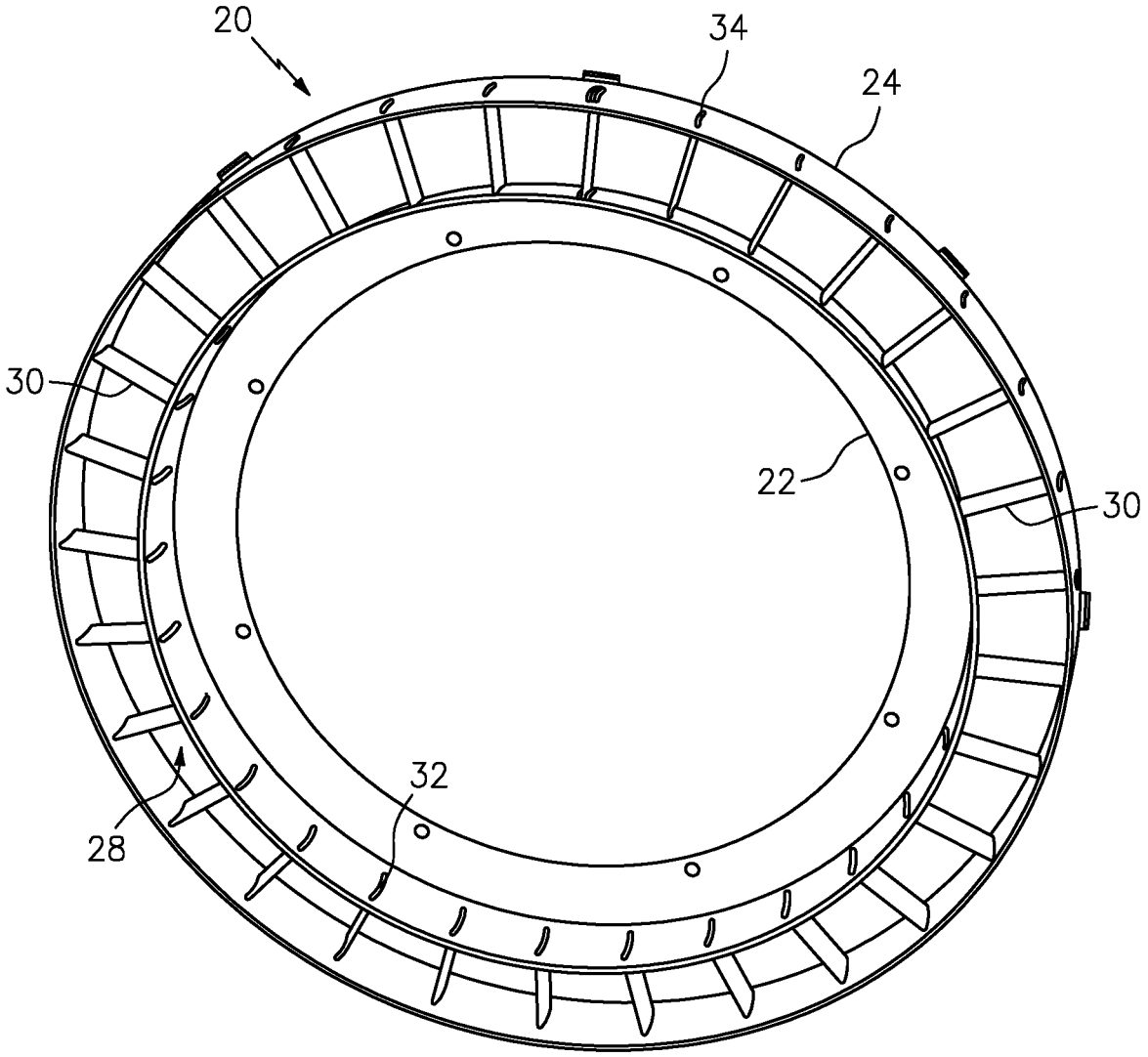
FIG. 2 is a perspective view of an exemplary vane assembly.
Figure 3:
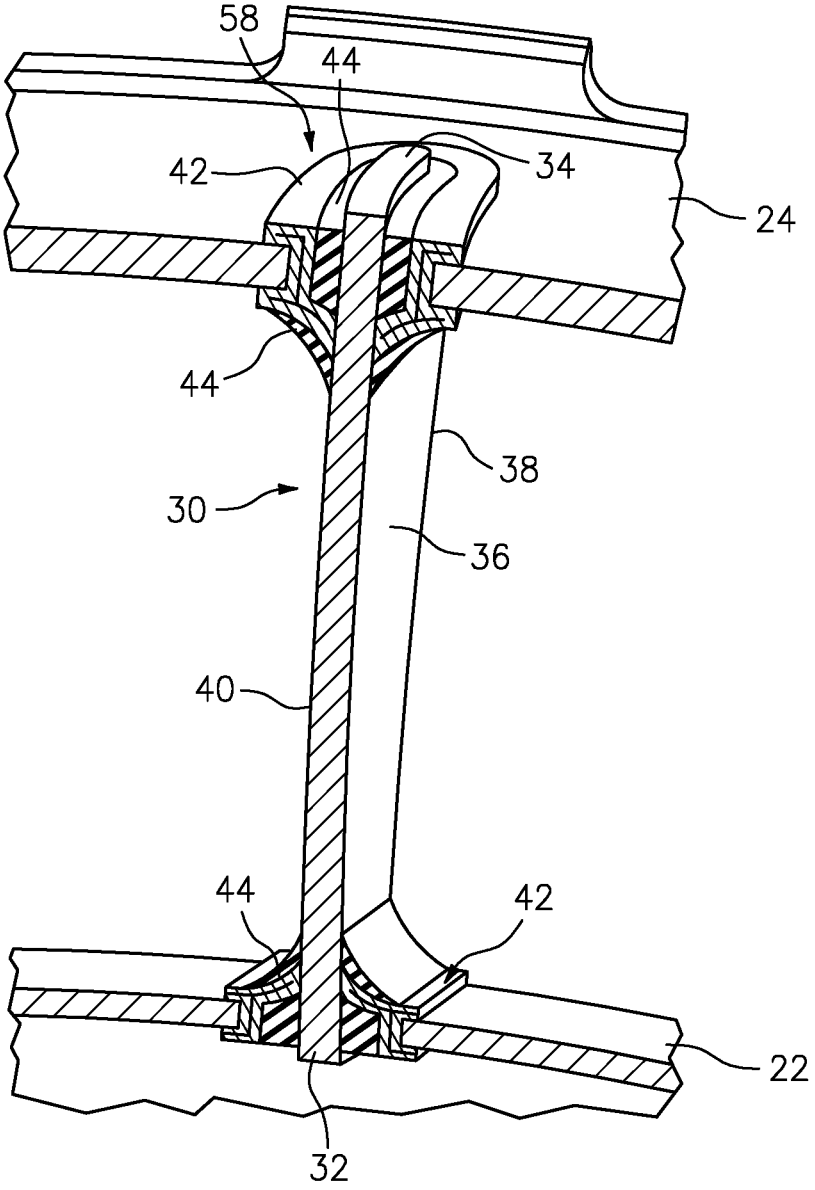
FIG. 3. is a cross sectional perspective view of a single vane in the exemplary assembly.

Referring also to FIG. 2 and FIG. 3, a vane assembly 20 is shown. The vane assembly 20 comprises an inner shroud 22 concentric with a casing or outer shroud 24 and located downstream of rotating blades 26 (not shown), the inner shroud 26 and outer shroud 24 defining an annular gas flow path 28 therebetween, and a plurality of vanes 30 extending radially between the outer shroud 24 and the inner shroud 26 downstream of the rotor blades 22. In an exemplary embodiment the shrouds 22, 24 can be segmented. Each of the vanes 30 has a vane root 32 retained in the inner shroud 22, a vane tip 34 retained in the outer shroud 24, and an airfoil portion 36 extending therebetween. The airfoil portion 36 of each vane 30 defines a relatively sharp leading edge 38 and a relatively sharp trailing edge 40, such that an airflow coming from the blades 22 and passing through the vane assembly 20 will flow over the vane airfoil 36 from the leading edge 38 to the trailing edge 40.

Throughout this description, the axial, radial and circumferential directions are defined respectively with respect to the central axis, radius and circumference of the engine 10.

Figure 4:
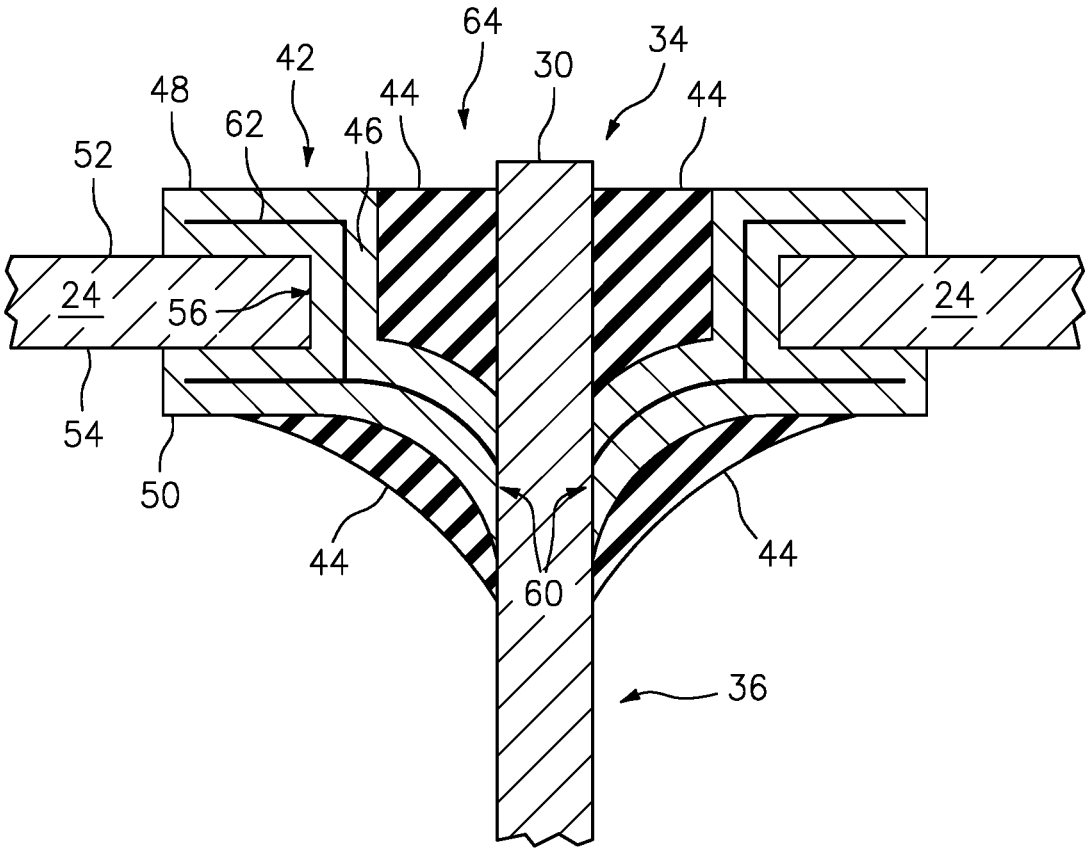
FIG. 4. is a cross sectional perspective view of an exemplary grommet assembly coupled with a single vane in a slot.

Referring also to FIG. 4, an exemplary grommet 42 is shown with the vane 30 installed in the outer shroud 24 (or inner shroud 22, shown at FIG. 3). The grommet 42 serves to retain the vane in the shroud 22, 24. An adhesive rubber potting 44 is coupled to the vane 30 along with the grommet 42. The grommet 42 can be installed with the inner shroud 22 as a mirror image orientation of the outer shroud 24.

The grommet 42 includes a body portion 46 having a first lip 48 opposite a second lip 50 configured to securely attach to the outer shroud 24 on a top surface 52 and bottom surface 54 respectfully. The body portion 46 of the grommet 42 includes a slot receiver 56 that is formed between the first lip 48 and second lip 50. The slot receiver 56 is adapted to fit into the slot 58 of the upper shroud 24 and couple the grommet 42 to the upper shroud 24 (or inner shroud 22).

The body portion 46 of the grommet 42 also includes a vane receiver 60. The vane receiver 60 couples the vane 30 to the grommet 42. The vane receiver 60 impinges the vane 30 proximate the outer shroud 24. In an exemplary embodiment the vane receiver 60 couples to the vane 30 below the outer shroud 24 (axially inboard at or below the bottom surface 54).

The grommet 42 can include a fiber 62 configured to reinforce the grommet 42 structure. In an exemplary embodiment, the grommet 42 can be made of a silicone material, such as AMS™ 302 silicone. The fiber 62 can include strands of fabric, such as a Dacron™ D117™ polyester fabric. In an exemplary embodiment the grommet thickness between the vane 30 and the slot 58 of the outer shroud can be about 0.03 inches and the potting can have a thickness of about 0.07 inches.

The fiber 62 can extend into each of the first and second lips 48, 50, the body proximate the slot receiver 56 and into the vane receiver 60 of the grommet 42. The fiber 62 provides greater strength for the grommet 42 to resist tearing or cracking from the forces encountered during operation. The fiber 62 provides the advantage of preventing the propagation of cracks that may form in the grommet 42.

The potting 44 can be installed along with the grommet 42. The potting 44 can be located between the grommet body portion 46 above and/or below the vane receiver 60 and coupled to the vane 30 above the outer shroud 24. The potting 44 can be installed proximate the vane receiver 60 below the outer shroud 24.

The grommet 42 is configured to occupy a minimal amount of space in the slot 58 with a minimal thickness. The potting 44 can fill the gaps 64 between the slot 58 and vane 30. The grommet 42 can be utilized with a variety of vane 30 and slot 58 configurations, since the potting 44 can be variable in dimensions to fill the gaps 64. The gaps 64 are designed to provide a minimum thickness to ensure damping, and the remaining gap 64 takes up the tolerance between the vane and shroud slot so that the airfoil can be located by a precise tool.

The grommet disclosed provides the advantage of preventing crack propagation through the grommet material.

The grommet also provide the advantage of allowing for a variety of vane 30 and slot 58 designs without sacrificing the durability.

There has been provided a hybrid rubber grommet. While the hybrid rubber grommet has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A hybrid grommet assembly for a vane comprising:

a body portion comprising a first lip opposite a second lip forming a slot receiver, said slot receiver configured to receive a shroud slot of a shroud; said body portion comprising a vane receiver extending from said body portion and configured to receive a vane, the vane receiver configured to directly couple the vane to the grommet;

a fiber integral within said body portion; and an adhesive rubber potting coupled to said grommet proximate said vane receiver, wherein said potting fills a gap between the grommet and the vane.

2. The hybrid grommet assembly according to claim 1, wherein said fiber extends into each of the first lip, the second lip, the body portion proximate the slot receiver and the vane receiver of the grommet.

3. The hybrid grommet assembly according to claim 1, wherein said potting is located between the grommet body portion at least one of above and below the vane receiver and coupled to the vane above the shroud.

4. The hybrid grommet assembly according to claim 3, wherein the potting is located proximate the vane receiver below the shroud.

5. The hybrid grommet assembly according to claim 1, wherein said slot receiver is configured to couple the grommet to the shroud.

6. The hybrid grommet assembly according to claim 1, wherein said fiber comprises strands of fabric.

7. The hybrid grommet assembly according to claim 1, wherein said body portion between the vane and the slot of the shroud has a thickness of about 0.03 inches and the potting has a thickness of about 0.07 inches.

8. A vane and shroud assembly with a hybrid grommet assembly comprising:

an inner shroud concentric with an outer shroud defining an annular gas flow path therebetween;

a plurality of vanes extending radially between the outer shroud and the inner shroud;

a grommet assembly coupled to the vane proximate said outer shroud and said inner shroud, each of said outer shroud and said inner shroud having a slot, said grommet assembly comprising:

a grommet having a body portion comprising a first lip opposite a second lip forming a slot receiver, said slot receiver configured to receive the slot; said body portion comprising a vane receiver extending from said body portion and configured to receive said vane, the vane receiver directly couples the vane to the grommet;

a fiber integral within said body portion; and an adhesive rubber potting coupled to said grommet proximate said vane receiver, wherein said potting fills a gap between the grommet and the vane.

9. The vane and shroud assembly with a hybrid grommet assembly according to claim 8, wherein said fiber extends into each of the first lip, the second lip, the body portion proximate the slot receiver and the vane receiver of the grommet.

10. The vane and shroud assembly with a hybrid grommet assembly according to claim 8, wherein said potting is located between the grommet body portion above and below the vane receiver and coupled to the vane above the outer shroud and below the inner shroud away from the annular gas flow path.

11. The vane and shroud assembly with a hybrid grommet assembly according to claim 8, wherein the potting is located proximate the vane receiver and proximate the annular gas flow path.

12. The vane and shroud assembly with a hybrid grommet assembly according to claim 8, wherein said fiber comprises strands of fabric.

13. The vane and shroud assembly with a hybrid grommet assembly according to claim 8, wherein said slot receiver is configured to couple the grommet to the slot.

14. A process for attaching a vane to a shroud slot comprising:

providing a shroud having an upper surface and a lower surface, said shroud having a slot;

attaching a grommet to said shroud, wherein said grommet comprises:

a body portion comprising a first lip opposite a second lip forming a slot receiver, said slot receiver configured to receive the slot; said body portion comprising a vane receiver extending from said body portion and configured to receive a vane, the vane receiver directly couples the vane to the grommet;

a fiber integral within said body portion, wherein said fiber extends into each of the first lip, the second lip, the body portion proximate the slot receiver and the vane receiver of the grommet;

inserting the vane into the vane receiver; and coupling an adhesive rubber potting to said grommet proximate said vane receiver, wherein said potting fills a gap between the grommet and the vane.

15. The process of claim 14, wherein said potting is located between the grommet body portion above and below the vane receiver and coupled to the vane above the shroud.

16. The process of claim 14, wherein said fiber comprises strands of fabric.

17. The process of claim 14, wherein the potting is located proximate the vane receiver opposite the shroud.

18. The process of claim 14, further comprising;

varying a thickness of the potting to fit said grommet in said slot.

19. The process of claim 18, wherein said body portion between the vane and the slot of the shroud has a thickness of about 0.03 inches and the potting has a thickness of about 0.07 inches.

* * * * *